US007050733B2

(12) United States Patent
Saito et al.

(10) Patent No.: US 7,050,733 B2
(45) Date of Patent: May 23, 2006

(54) IMAGE FORMING APPARATUS INCLUDING TWO DEVELOPER CARRYING MEMBERS WHEREIN POTENTIAL DIFFERENCES BETWEEN THE DEVELOPER CARRYING MEMBERS AND A COMMON VOLTAGE SOURCE DIFFER

(75) Inventors: Masanobu Saito, Shizuoka-ken (JP); Seiji Yamaguchi, Mishima (JP); Yasunari Watanabe, Shizuoka-ken (JP); Kazunori Hashimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 254 days.

(21) Appl. No.: 10/715,533

(22) Filed: Nov. 19, 2003

(65) Prior Publication Data

US 2004/0136742 A1 Jul. 15, 2004

(30) Foreign Application Priority Data

Nov. 19, 2002 (JP) ..... 2002/335835
Oct. 29, 2003 (JP) ..... 2003/369718

(51) Int. Cl.
*G03G 15/06* (2006.01)
*G03G 15/01* (2006.01)

(52) U.S. Cl. ..... 399/55; 399/223

(58) Field of Classification Search ..... None
See application file for complete search history.

(56) References Cited

U.S. PATENT DOCUMENTS 5,376,998 A * 12/1994 Suzuki ..... 399/88
5,862,438 A * 1/1999 Folkins ..... 399/88
6,029,018 A * 2/2000 Rogers et al. ..... 399/12
6,167,212 A 12/2000 Satoh et al. ..... 399/55
6,272,306 B1 8/2001 Saito et al. ..... 399/270
6,278,849 B1 * 8/2001 Kawasaki ..... 399/55
6,415,127 B1 7/2002 Yamamoto et al. ..... 399/284
6,751,423 B1 * 6/2004 Sakaizawa et al. ..... 399/55
2003/0077088 A1 4/2003 Adachi et al. ..... 399/129

FOREIGN PATENT DOCUMENTS

JP 04093963 A * 3/1992
JP 6-289703 10/1994

OTHER PUBLICATIONS

U.S. Appl. No. 10/714,636, filed Nov. 18, 2003, Saito et al., pending.
U.S. Appl. No. 10/617,024, filed Jul. 11, 2003, Watanabe et al., pending.
U.S. Appl. No. 10/671,690, filed Sep. 29, 2003, Saito et al., pending.

* cited by examiner

*Primary Examiner*—Robert Beatty
(74) *Attorney, Agent, or Firm*—Fitzpatrick, Cella, Harper & Scinto

(57) ABSTRACT

An image forming apparatus includes a plurality of developing devices each including a developer carrying member for carrying a developer to develop an electrostatic latent image formed on an image bearing member, and a developer regulating member for regulating the developer carried on the developer carrying member; a common voltage applying device for applying a common voltage to the plurality of the developer regulating member. When a first one of the developer carrying members is rotating, and when a second one of the developer carrying members is not rotating, a potential difference between a potential of the second developer carrying member and the common voltage is smaller than a potential difference between a potential of the first developer carrying member and the common voltage.

13 Claims, 10 Drawing Sheets

IMAGE FORMING APPARATUS INCLUDING TWO DEVELOPER CARRYING MEMBERS WHEREIN POTENTIAL DIFFERENCES BETWEEN THE DEVELOPER CARRYING MEMBERS AND A COMMON VOLTAGE SOURCE DIFFER

FIELD OF THE INVENTION AND RELATED ART

The present invention relates to an image forming apparatus, such as a copying machine, a laser beam printer, etc., which employs an electrophotographic or electrostatic recording method.

In recent years, an electrophotographic image forming apparatus has been improved in process speed and functionality, and also, colorization is in progress in the field of an electrophotographic image forming apparatus. Thus, various image forming methods have been proposed for an image forming apparatus. From the standpoint of increasing process speed, an in-line type image forming apparatus in which multiple image formation stations (image formation units) different in the color in which they form an image, are arranged in a straight line, and are simultaneously driven to form an image, has been researched and developed. An image forming apparatus of this type is capable of forming a color image at a high speed, and therefore, it is thought to be extremely useful in the field of business, for example, in which the demand for high speed printing is great.

Some of the image forming apparatuses of this in-line type employ an image forming method which employs an intermediary transfer means. In this image forming method, multiple developer images (toner images) different in color are temporarily transferred (primary transfer) in layers onto an intermediary transfer medium, and then, are transferred (secondary transfer) all at once from the intermediary transfer medium onto a final transfer medium, for example, recording paper, OHP sheet, fabric, etc., yielding a permanent image.

FIG. 8 is a schematic sectional view of the essential portion of an image forming apparatus of the above described type. The image forming apparatus 200 in the drawing has multiple image forming means, for example, first to fourth image formation stations PY, PM, PC, and PBk for forming yellow (Y), magenta (M), cyan (C), and black (Bk) images, respectively. In operation, toner images are formed of toner as developer, on the electrophotographic photosensitive members 10Y, 10M, 10C, and 10Bk, as image bearing members, in the form of a drum (which hereinafter will be referred to as "photosensitive drum") of the image formation stations, respectively, and the toner images are transferred (primary transfer) in layers onto the intermediary transfer medium 31 by the functions of the primary transferring means 26Y, 26M, 26C, and 26Bk, in the primary transfer stations N1, respectively. Thereafter, the toner images on the intermediary transfer medium 31 are transferred all at once onto the final transfer medium S by the function of the secondary transferring means 32, in the secondary transfer station N2. During this secondary transfer, the transfer medium S is conveyed by the intermediary transfer medium 31 and the secondary transferring means 32, remaining pinched between them, with its front and back sides remaining in contact with the intermediary transfer medium 31 and secondary transferring means 32, respectively. Next, the operation of the image formation stations of the image forming apparatus 200 in FIG. 8 will be described in more detail. All the image formation stations are virtually the same in structure, except that they are different in the color of the images they form. Thus, hereinafter, unless it is necessary to specifically mention the differences among them, their components will be described in generic terms, and, therefore, will not be given referential symbols which indicate to which image formation station a given component belongs.

In each image formation station, the photosensitive drum 10 is rotationally driven in the direction indicated by an arrow mark in the drawing. As it is rotationally driven, its peripheral surface is uniformly charged by the charge roller 11 as a charging means. Then, an electrostatic latent image, which reflects image formation signals, is formed across the uniformly charged portion of the peripheral surface of the photosensitive drum 10, by the exposing means (unshown). Then, this electrostatic latent image is developed by the developing means 13, which adheres toner to the electrostatic latent image. As a result, a visible image, which corresponds to the electrostatic latent image, is effected on the peripheral surface of the photosensitive drum 10.

The charge roller 11 is connected to a high voltage power source (unshown) through its electrodes. As voltage is applied to the charge roller 11, it uniformly charges the peripheral surface of the photosensitive drum 10 to a predetermined potential level. The charge roller 11 is kept pressed on the peripheral surface of the photosensitive drum 10 with the application of a predetermined amount of pressure, and charges the photosensitive drum 10 as it is rotated by the rotation of the photosensitive drum 10.

As the exposing means, a laser scanner (unshown), for example, is employed. It supplies optical signals modulated with the image formation signals from an image formation signal source, providing the numerous points on the uniformly charged portion of the peripheral surface of the photosensitive drum 10 with an optical signal L. As a result, an electrostatic latent image, which reflects the image formations signals, is formed on the peripheral surface of the photosensitive drum 10.

As for the developing means 13, there has been available such a means that comprises a development roller 16 as a developer bearing means for conveying developer to a photosensitive member, and develops the electrostatic latent image on the photosensitive drum 10 by placing the development roller 16 in contact with the photosensitive drum 10 (which hereinafter will be referred to as "contact developing method"). In this developing method, a visible image corresponding to the electrostatic latent image on the photosensitive drum 10 is formed on the photosensitive drum 10, in the contact area (development station) between the photosensitive drum and development roller 16, by moving toner from the development roller 16 onto the electrostatic latent image on the photosensitive drum 10, adhering thereby the toner thereto, by the amount controlled by the relationship between the light potential level of the electrostatic latent image and the potential level of the bias voltage applied to the development roller 16.

A developing means (developing apparatus 13) employing this type of developing method has a contact development roller 16, a toner supply roller 18, and a development blade 17, which are disposed in the developer container (main frame of developing apparatus). The contact development roller 16 is placed in contact with the photosensitive drum 10. The developer supply roller 18 functions as a developer supplying member for supplying the development roller 16 with toner. The development blade 17 functions as a developer regulating member for regulating the toner supplied to the development roller 16. Further, the developing means is provided with a set of high voltage power sources (blade bias power sources) 22*a* and 22*b*, as voltage applying means, for applying voltage to the development blades 17, and a set of high voltage power sources (development bias power sources) 23Y, 23M, 23C, and 23Bk, as voltage applying means, for applying voltage to development rollers 16 and toner supply rollers 18.

Each developing apparatus 13 is structured so that the development roller 16 is rotated by the rotation of the photosensitive drum 10 as it is placed in contact with the peripheral surface of the photosensitive drum 10 and also so that the development roller 16 is partially exposed from the developer container 20.

Further, each developing apparatus 13 is structured so that the development blade 17 is placed in contact with the development roller 16. The body of toner placed on the peripheral surface of the development roller 16 is forced through the contact area between the development blade 17 and development roller 16, being thereby regulated in thickness, forming therefore a thin layer of toner on the peripheral surface of the development roller 16. In addition, while the body of toner is forced through the contact area, the toner particles are given a satisfactory amount of triboelectric charge.

Each toner supply roller 18 is disposed upstream of the development blade 17 in terms of the rotational direction of the development roller 16, in contact with the development roller 16. It supplies the development roller 16 with developer by rotating in the direction indicated by an arrow mark in the drawing (such a direction that, in contact area, peripheral surface of developer supply roller 18 moves in direction opposite to that in which peripheral surface of development roller 16 moves).

In some of the image forming apparatuses, the multiple image formation stations, which are vertically arranged in a straight line, are in the form of a process cartridge removably mountable in the main assembly of an image forming apparatus. For example in the case of the laser beam printer shown in FIG. 8, the photosensitive drum 10 as an image bearing member which is rotationally driven, the charger roller 11 as a charging means for uniformly charging the peripheral surface of the photosensitive drum 10, the developing apparatus 13 as a developing means for developing an electrostatic latent image into a visible image with the use of toner as developer, and the cleaning apparatus 14 as a cleaning means for cleaning the photosensitive drum 10, are integrally disposed in a cartridge (housing), effecting thereby a process cartridge 1 (1Y, 1M, 1C, and 1Bk), which is positioned in the image formation station P (PY, PM, PC, and PBk). The configuration of the process cartridge does not need to be limited to the above described one, as long as a photosensitive member with developer, and cleaning means for cleaning the photosensitive member, are integrally disposed in a cartridge removably mountable in the main assembly of an image forming apparatus. According to the process cartridge system, as a process cartridge having run out of one of the consumables, for example, developer, is replaced, other consumables such as a photosensitive drum are also replaced, drastically improving maintenance efficiency.

Further, an in-line type image forming apparatus is not always used to produce a multicolor image (for example, full-color image, that is, four-color image). For example, it is frequently used for forming a monochromatic image, in particular, a black image. Thus, a number of in-line type image forming apparatuses which can be switched in operational mode between the full-color mode and monochromatic mode, have been proposed.

In other words, an in-line type image forming apparatus, such as the ones described above, is not always used for the formation of a full-color print; it is sometimes used for the formation of a monochromatic print.

Next, referring to FIGS. 9 and 10, a full-color image forming apparatus capable of operating in the above described two modes, that is, monochromatic and full-color modes, will be described in more detail. FIGS. 9 and 10 are schematic sectional views of the essential portion, in particular, the portion comprising the photosensitive drum 10, developing apparatuses 13, primary transferring means 26, intermediary transfer medium 31, etc., of an example of an image forming apparatus which employs multiple developing apparatuses 13 of a contact type, and is capable of operating in the above described two chromatic modes. In the drawings, the elements other than those listed are not shown.

FIG. 9 shows the image forming apparatus in the full-color mode when the developing apparatuses 13 in all of the four color image formation stations PY, PM, PC, and PBk are active. In comparison, FIG. 10 shows the image forming apparatus in the monochromatic mode when the developing apparatuses 13Y, 13M, and 13C in the three process cartridges 1Y, 1M, and 1C for yellow, magenta, cyan color components, respectively, are inactive, and only the developing apparatus 13Bk in the process cartridge 1Bk for the black color component is active. When the image forming apparatus is in the monochromatic mode as shown in FIG. 10, the primary transferring means 26Y, 26M, and 26C are moved away from the corresponding photosensitive drums 10 by a separating means (unshown), in the yellow, is magenta, and cyan image formation stations PY, PM, and PC, respectively, so that the intermediary transfer medium 31 separates from the photosensitive drums 10, in the image formation stations PY, PM, and PC, respectively.

In order to individually adjust the density levels at which images are formed in the four image formation stations, there need to be four independent development bias power sources, that is, the power sources 23Y, 23M, 23C, and 23Bk.

Further, there need to be no less than two blade bias power sources, that is, power sources 22*a* and 22*b*, for applying bias to the development blades 17, because, as the image forming apparatus is switched to the monochromatic mode in which the developing apparatuses 13Y, 13M, and 13C in the three image formation stations PY, PM, and PC, that is, the image formation stations other than the black image formation station, are kept inactive, not only the application of the biases to the development rollers 16Y, 16M, and 16C has to be stopped, but also, the application of the biases to the development blades 17 in the three color image formation stations PY, PM, and PC has to be stopped, for the following reason. That is, as the rotation of the development roller 16 is stopped, a certain amount of toner particles becomes stuck in the nip between the development blade 17 and development roller 16, and is deteriorated by the electric current which flows between the development blade 17 and development roller 16. Thus, if the application of the bias to the development blade 17 is continued, these toner particles sometimes are solidly adhered to the development blade 17. If the toner particles adhere to the development blade 17, the development blade 17 is prevented from uniformly coating the development roller 16 with toner, which sometimes results in the formation of a streaky image.

As will be evident from the above description, in the past, an in-line type image forming apparatus, such as the one described above, capable of forming a full-color image based on four color components required a minimum of two development bias power sources, one for the black image formation station and the other, as the common development bias source, for the rest, or thee color image forming stations PY, PM, and PC.

The provision of two or more development bias power sources, instead of one, adds to the size of the electrical circuit board, and the cost of the apparatus, which is a problem.

Incidentally, an image forming apparatus in which bias is applied to the development blade has been known, being disclosed in Japanese Laid-open Patent Application 6-289703, although the apparatus is not of an in-line type.

SUMMARY OF THE INVENTION

The primary object of the present invention is to provide an image forming apparatus which has multiple developer regulating members, but has only a single developer regulating member power source, and in which the single developer regulating member power source is used to apply bias to all the multiple developer regulating members.

Another object of the present invention is to make it possible for a single voltage applying means to be used to apply voltage to multiple developer regulating members, so that an image forming apparatus can be reduced in size and cost.

Another object of the present invention is to provided an image forming apparatus capable of forming a monochromatic image, for example an image of black color, as well as a multicolor image, for example, a full-color image.

Another object of the present invention is to provide an image forming apparatus which comprises multiple developer bearing members, and is capable of preventing developer from solidly adhering to any of the developer regulating member kept in contact with the stationary developer bearing member, preventing thereby the formation of an image having unwanted straight streaks associated with the solid developer adhesion to the developer regulating member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention, in the form of an image forming apparatus, will be described in detail with reference to the appended drawings.

Embodiment 1

The present invention is embodied in the form of an in-line type image forming apparatus employing a contact type developing method. This does not mean that the application of this embodiment is limited to an image forming apparatus of the above mentioned type. In other words, the present invention is applicable to any image forming apparatus in accordance with the following description of the preferred embodiments of the present invention, in terms of configuration as well as image formation method.

Figure 1:
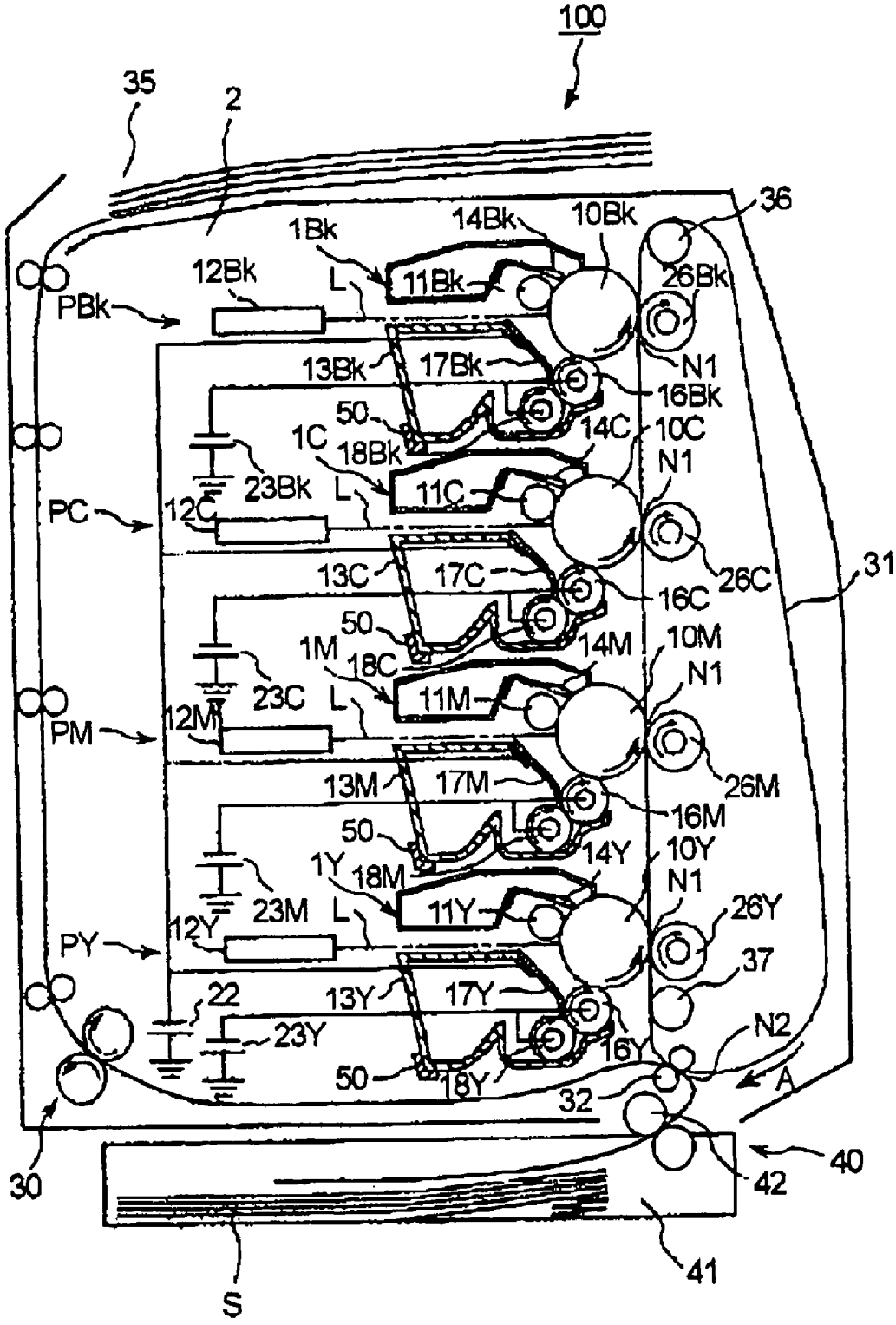
FIG. 1 is a schematic sectional view of the image forming apparatus in an embodiment of the present invention.

FIG. 1 is a schematic sectional view of the image forming apparatus 100 in this embodiment of the present invention. The image forming apparatus 100 in this embodiment is an electrophotographic image forming apparatus connected to an external host such as a personal computer. It is capable of outputting an image on a piece of transfer medium, for example, recording paper, OHP sheet, fabric, etc., in response to image formation data signals from the external host.

The image forming apparatus 100 has first to fourth image formation stations (image formation units) PY, PM, PC, and Pbk, as image forming means, which form yellow (Y), magenta (M), cyan (C), and black (Bk) images, respectively. The four image formation units PY, PM, PC, and Pbk are disposed in parallel with each other and perpendicular to an intermediary transfer member (transfer belt) 31, as a transfer medium, which circularly moves in the direction indicated by an arrow mark in the drawing. More specifically, listing from the bottom in FIG. 1, yellow, magenta, cyan, and black image formation units PY, PM, PC, and Pbk are vertically aligned in parallel with each other, and a full-color image is formed by sequentially transferring yellow, magenta, cyan, and black color toner images from the image formation units PY, PM, PC, and Pbk, respectively, onto the intermediary transfer belt 31, yielding thereby a full-color image, on the belt 31.

Figure 2:
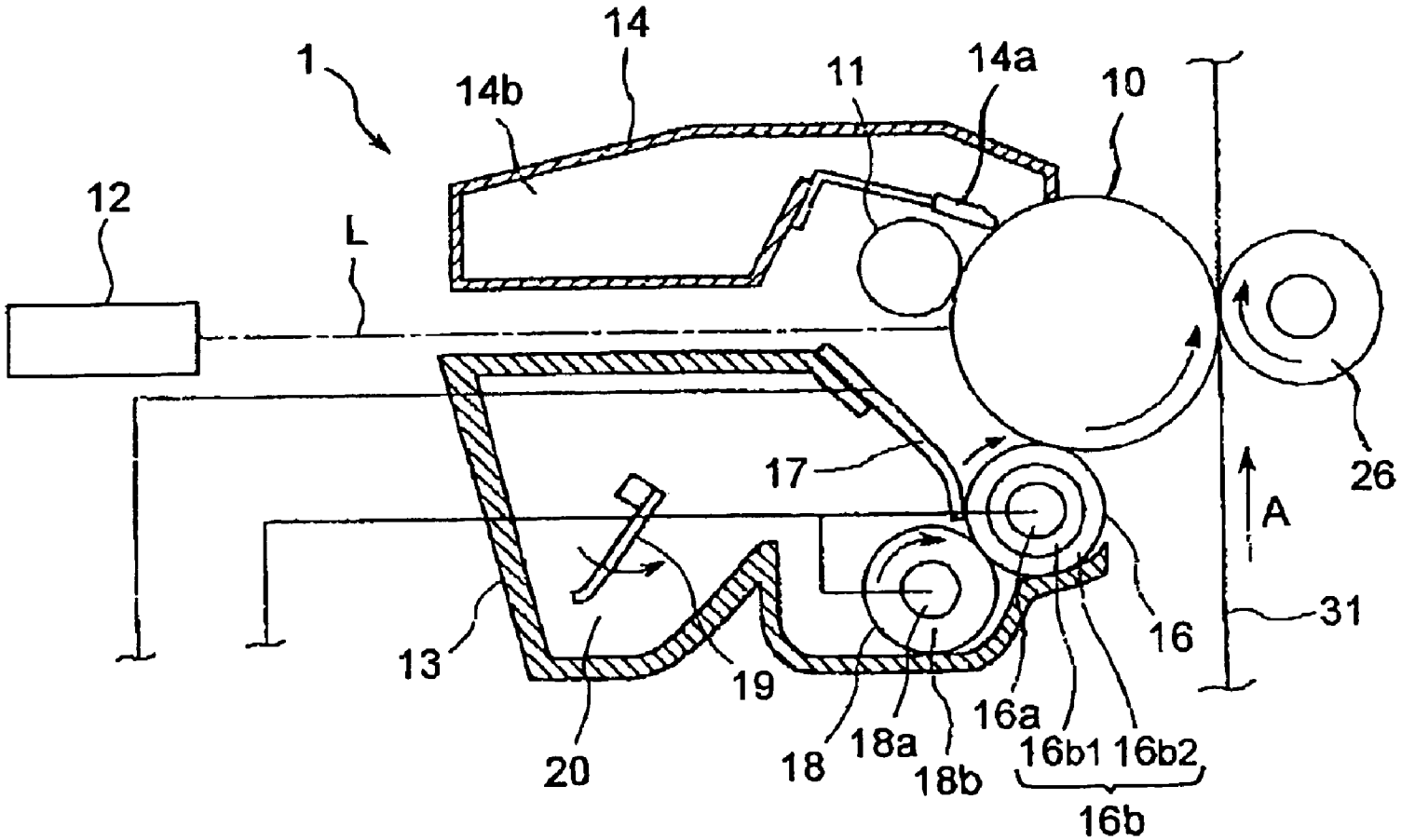
FIG. 2 is a detailed schematic sectional view of one of the image formation stations of the image forming apparatus in FIG. 1.

FIG. 2 shows in more detail one of the image formation stations. Incidentally, in this embodiment, all the image formation stations are virtually the same in structure, except that they are different in the color of the images they form. Thus, hereinafter, unless the differences need to be specifically noted, their components will be described in generic terms, and, therefore, will not be given referential symbols which indicate the colors of the image formation stations to which they belong.

Each image formation station is provided with an electrophotographic photosensitive member, as an image bearing member, in the form of a drum (photosensitive drum) 10. The peripheral surface of the photosensitive drum 10 is uniformly charged by a charge roller 11, as a charging means, which is rotated by the rotation of the photosensitive drum 10. Then, the charged portion of the peripheral surface of the photosensitive drum 10 is exposed to a scanning beam of light L projected by an exposing apparatus 12, as an exposing means, while being modulated with the image formation data signals. As a result, an electrostatic latent image is formed on the peripheral surface of the photosensitive drum 10. To this electrostatic latent image, toner as developer is adhered by a developing apparatus 13 as a developing means, turning the latent image into a visible image (toner image), that is, an image formed of developer.

When forming an image in the full-color image formation mode, toner images different in color are formed on the photosensitive drums 10 in the image formation stations, one for one, and as predetermined primary transfer biases are applied to the primary transfer rollers 26 as primary transferring means, the toner images on the photosensitive drums 10 are sequentially transferred in layers onto the intermediary transfer belt 31, in the primary transfer stations N1 of the image formation stations, in which the peripheral surfaces of the photosensitive drums 10 and primary transfer rollers 26 are in contact, or virtually in contact with, each other, one for one. As a result, a full-color image is formed on the intermediary transfer belt 31.

Next, a predetermined secondary transfer bias is applied to the secondary transfer roller 32 as a secondary transferring means, whereby the full-color image (combination of toner images) on the intermediary transfer belt 31 is transferred (secondary transfer) onto a final transfer medium S. The transfer medium S is fed into the main assembly of the image forming apparatus 100 from a transfer medium supply station 40 comprising a transfer medium cassette 41, a pair of transfer supply rollers 42 as a conveying means, etc., and is delivered, in synchronism with the transfer of the toner images onto the intermediary transfer belt 31, to the secondary transfer station N2, in which the secondary transfer roller 32 opposes the intermediary transfer belt 31.

Thereafter, the transfer medium S onto which the toner images have just been transferred is conveyed to a fixing apparatus 30, in which the unfixed toner images are fixed to the transfer medium S. Then, the transfer medium S onto which the toner images have just been fixed is discharged into the delivery tray 35, ending the image formation.

Meanwhile, the primary transfer residual toner particles, that is, the toner particles which remained on the peripheral surface of the photosensitive drums 10 without being transferred during the primary transfer, are recovered into a waste toner container 14*b* by cleaning apparatuses 14, as image bearing member cleaning means, comprising a cleaning blade 14*a* as a cleaning member and the waste toner container 14*b*; the peripheral surfaces of the photosensitive drums 10 are cleaned. On the other hand, the secondary transfer residual toner particles, that is, the toner particles which remained on the intermediary transfer belt 31 without being transferred during the secondary transfer, are scraped away by an intermediary transfer member cleaning means (unshown) disposed so that it can be placed in contact with, or moved away from, the intermediary transfer belt 31; the surface of the intermediary transfer belt 31 is cleaned.

In this embodiment, each photosensitive member 10 is 30 mm in diameter, and is rotationally driven at a peripheral velocity of 100 mm/sec in the direction indicated by an arrow mark in the drawing. The peripheral surface of the photosensitive drum 10 is uniformly charged by the charge roller 11.

To each charge roller 11, a DC voltage of −1150 V is applied from a charge bias power source (unshown), which is a high voltage power source, uniformly charging the peripheral surface of the photosensitive drum 10 to a potential level of roughly −600 V (dark point potential level). Although the charge bias used in this embodiment is DC bias, a combination of DC and AC components may be used as the charge bias.

Each exposing apparatus 12 exposes the peripheral surface of the photosensitive drum 10; more specifically, it scans the peripheral surface of the photosensitive drum 10 with a beam of laser light, which it projects, while turning it on and off in response to the image formation data inputted into the image forming apparatus. As a result, the exposed points on the peripheral surface of the photosensitive drum 10 are reduced in potential level to roughly −80 V (light point potential level), effecting thereby an electrostatic latent image, on the peripheral surface of the photosensitive drum 10.

Figure 8:
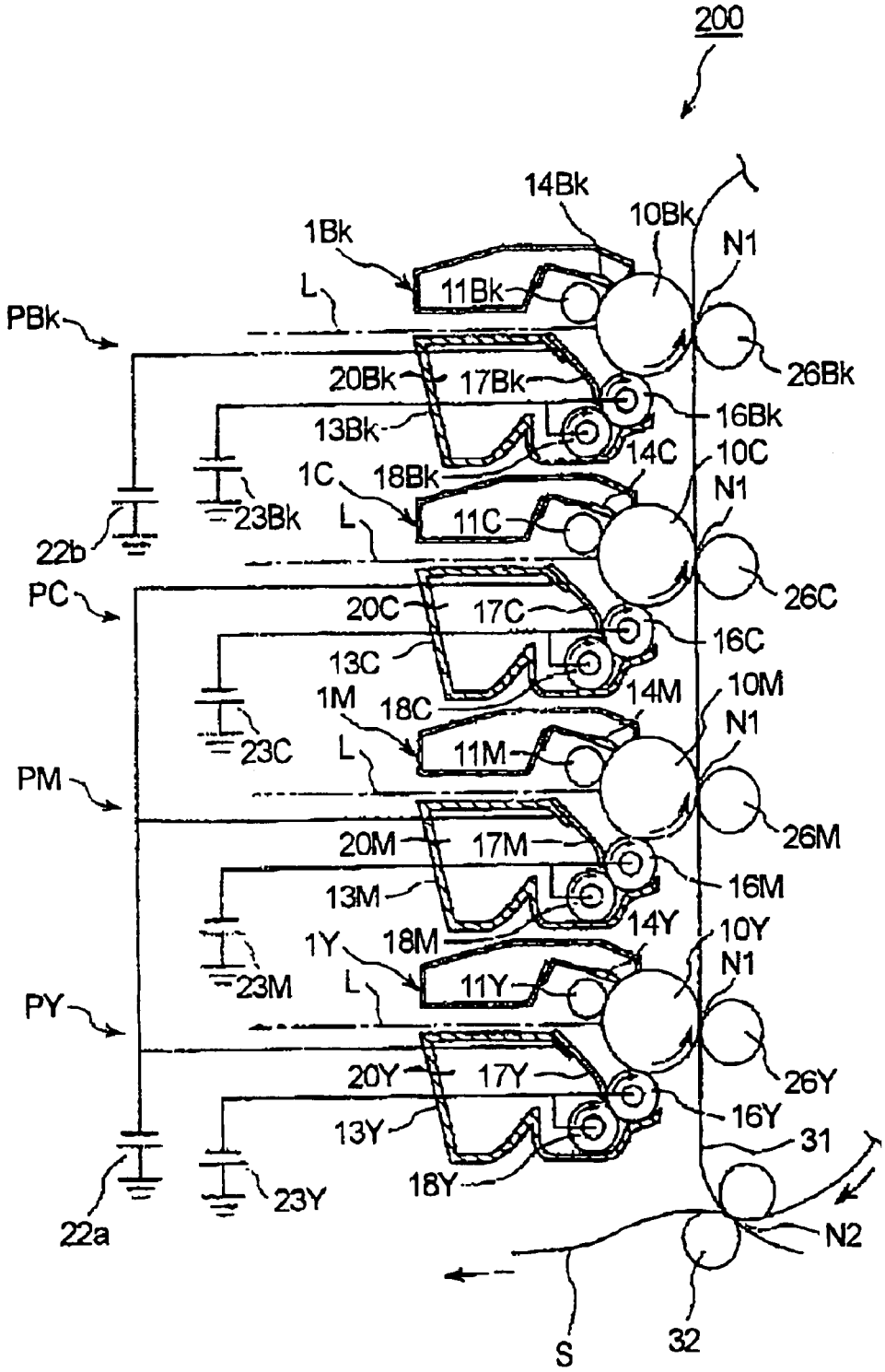
FIG. 8 is a schematic sectional view of the essential portion of an example of a comparative image forming apparatus.
Figure 9:
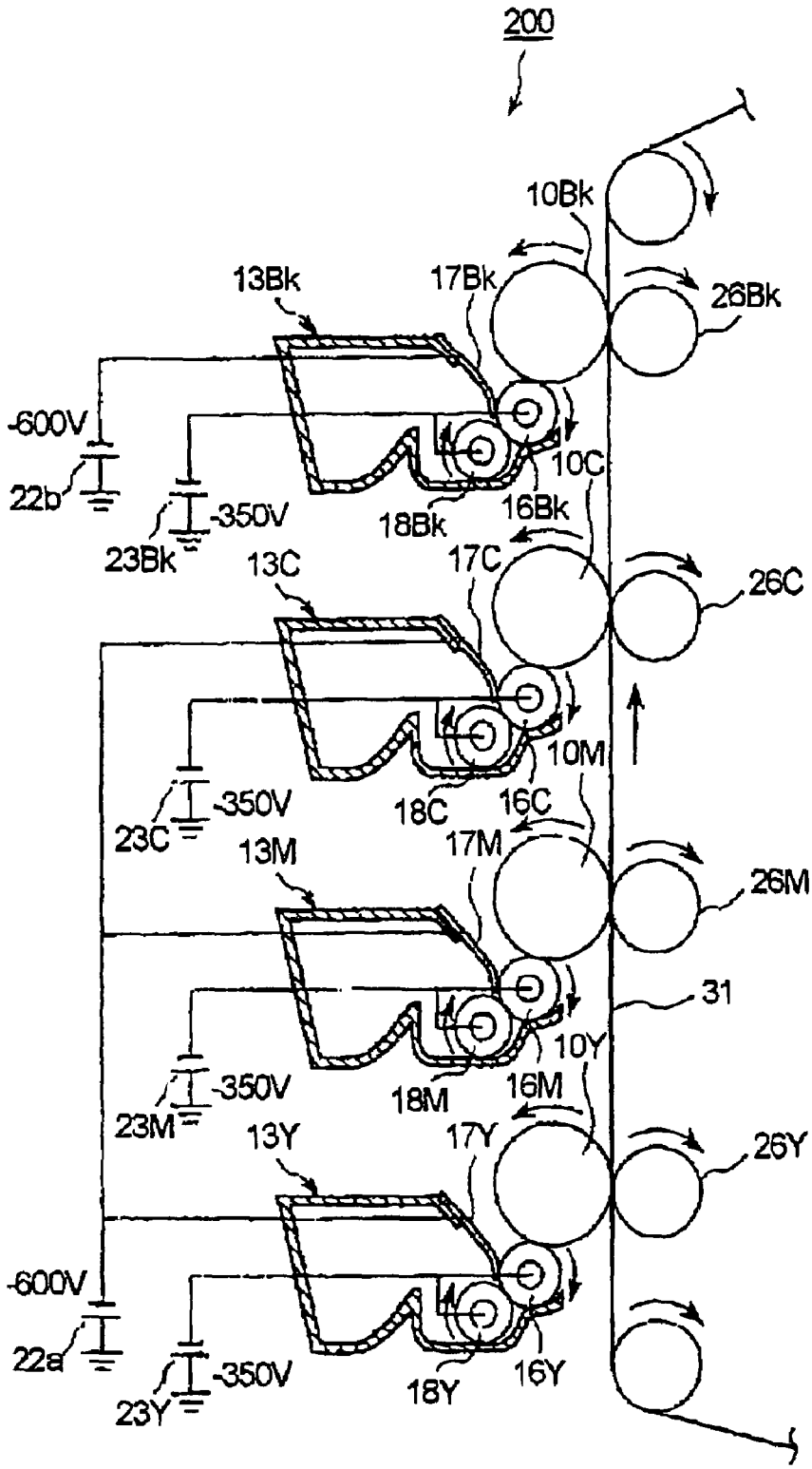
FIG. 9 is a schematic sectional view of the image forming apparatus in FIG. 8, showing the state thereof when the apparatus is in the full-color print mode.

Each developing apparatus 13 is roughly the same in structure as the one described above with reference to FIG. 8. It develops in reverse the electrostatic latent image on the photosensitive drum 10 with the use of a contact developing method, and a toner which is the same in polarity (which is negative in this embodiment) as the photosensitive drum 10.

To describe in more detail with reference to FIG. 2, the developing apparatus 13 comprises: a developer container (developing apparatus main frame) 20, in which nonmagnetic toner as developer (single-component toner as single-component developer), is contained; a development roller 16 as a developer bearing member; a development blade 17 as a developer regulating member; a toner supply roller 18 as a developer supplying member; and a stirring blade 19 as a developer stirring/conveying means.

The development roller 16 in this embodiment comprises a metallic core 16*a*, and an elastic layer 16*b* formed on the peripheral surface of the metallic core 16*a*. It is 16 mm in external diameter. The metallic core 16*a* is formed of metal such as aluminum, aluminum alloy, etc., and the elastic layer 16*b* comprises a base layer 16*b*1, and a surface layer 16*b*2 layered on the base layer 16*b*1. The base layer 16*b*1 of the elastic layer 16*b* is formed of rubbery substance such as silicon rubber, and the surface layer 16*b*2 of the elastic layer 16*b* is formed of ether-urethane or nylon. Of course, the materials for these layers are not limited to those listed above; it is possible to employ a foamed substance, for example, a sponge material, as the material for the base layer 16*b*1, and rubbery substance as the material for the surface layer 16*b*2. The electrical resistance of the development roller 16 was 1 MΩ, which was measured while the development roller 16 was kept pressed on a metallic cylinder with a diameter of 30 mm, applying the total weight of 1 kg, and while a voltage of 50 V was applied to the development roller. In this embodiment, the development roller 16 is rotationally driven by a driving means (unshown) at a peripheral velocity of 160 mm/sec.

The electrostatic latent image on the photosensitive drum 10 is developed into a visual image (image formed of toner)

by the toner borne on the peripheral surface of the development roller 16 placed in contact with the peripheral surface of the photosensitive drum 10, forming a development station (contact area) between the development roller 16 and photosensitive drum 10. During this development process, a negative DC voltage (development bias voltage) of 350 V is applied to the development roller 16 from a high voltage power source (development bias power source 23Y, 23M, 23C, or 23Bk), as a development voltage applying means, causing the negatively charged toner particles to transfer from the development roller 16 onto the electrostatic latent image on the photosensitive drum 10. Incidentally, a combination of DC voltage and AC voltage may be applied as the development bias voltage to the development roller 16, instead of applying the DC voltage alone.

As described above, in the case of an in-line developing method, four developing apparatuses 13 are present, which are adjustable in the density level at which they develop a latent image. This is why the four development bias power sources 23Y, 23M, 23C, and 23Bk, as voltage applying means, are provided, one for each of the four developing apparatuses 13. The development bias power sources 23Y, 23M, 23C, and 23Bk are capable of individually changing the potential levels of the DC voltages they output. All that is necessary to adjust the image density level at which an image is formed in each of the color image formation stations is to form an image of the referential density level control patch with the use of each color image formation station; detect the density level of the image with the use of an image density sensor as an image density detecting means; and control, in power output, each of the development bias power sources 23Y, 23M, 23C, and 23Bk, in accordance with the results of the density level detection. In other words, the development bias to be applied to each development roller has only to be controlled in accordance with the detected density level of the image of the referential density level control patch. As for the medium on which an image of the referential density level control patch, which is to be measured in density level by the density sensor, is to be formed, it may be the intermediary transfer belt or photosensitive drum.

There is a development blade 17, as a developer regulating member, above the development roller 16, and is supported by the developer container 20, with its surface adjacent to its free long edge kept lightly in contact with the peripheral surface of the development roller 16.

In this embodiment, the development blade 17 is tilted, with its free long edge positioned upstream of the contact area between the development blade 17 and development roller 16, in terms of the rotational direction of the development roller 16; in other words, it is tilted in the so-called counter direction. More concretely, the development blade 17 is a piece of 0.1 mm thick phosphor bronze plate, which is springy. It is kept in contact with the peripheral surface of the development roller 16 so that a predetermined amount of pressure (linear pressure) is maintained between the development blade 17 and development roller 16. With the development blade 17 kept pressed against the peripheral surface of the development roller 16 in a manner to maintain the predetermined contact pressure between them, the toner particles (10) are frictionally charged to the negative polarity while being controlled in the amount by which they are allowed to remain on the development roller 16.

To the development blade 17, a negative DC voltage (blade bias) of 600 V is applied from a high voltage power source (blade bias power source) as a regulating member voltage applying means, in order to stabilize the amount by which toner is allowed to remain on the peripheral surface of the development roller 16. There is only one blade bias power source 22, which is capable of applying to all the development blades 17 in the developing apparatuses 13Y, 13M, 13C, and 13Bk of the image formation stations PY, PM, PC, and PBk for yellow, magenta, cyan, and black colors, respectively, biases identical in potential level value.

The toner supply roller 18 may be in the form of a sponge roller, or a fur brush roller comprising a metallic core and rayon or nylon fibers planted on the peripheral surface of the metallic core. In this embodiment, an elastic roller with a diameter of 16 mm, which comprises a metallic core 18*a* and a urethane foam layer 18*b* wrapped around the core 18*a*, is employed as the toner supply roller 18, in consideration of the fact that toner is supplied to the development roller 16 from the toner supply roller 18, and also that the toner remaining on the development roller 16 without being consumed for development is to be stripped away from the development roller 16.

This toner supply roller 18, which is an elastic roller, is kept in contact with the development roller 16. During a development process, it is rotationally driven at a peripheral velocity of 100 mm/sec, in such a direction that, in the contact area between the peripheral surfaces of the toner supply roller 18 and development roller 16, the peripheral surface of the toner supply roller 18 moves in the direction opposite to the moving direction or the development roller 16. The distance of the apparent entry of the toner supply roller 18 into the development roller 16 is 1.5 mm.

As described above, the toner image on the peripheral surface of the photosensitive drum 10 is transferred onto the intermediary transfer belt 31 by a transfer roller 23 to which the primary transfer bias is being applied from a primary transfer bias power source (unshown) as a primary transfer bias applying means, and then, is transferred from the intermediary transfer belt 31 onto the transfer medium S by the secondary transfer roller 32 to which the secondary transfer bias is being applied from a secondary transfer bias power source (unshown) as a secondary transfer bias applying means. Thereafter, the toner image on the transfer medium S is fixed to the transfer medium S.

If the next set of image formation data is inputted into the image forming apparatus 100 immediately after the completion of the on-going image forming process, the following round of the image formation process is carried out, without interrupting the rotations of the photosensitive drum 10, development roller 16, toner supply roller 18, etc., and while keeping the development roller 16 the same in potential level.

In this embodiment, the developing apparatus 13, the photosensitive drum 10 which is rotationally driven, the charge roller 11 for uniformly charging the peripheral surface of the photosensitive drum 10, and the cleaning apparatus 14, are integrally disposed in a cartridge (housing), effecting thereby a process cartridge 1. Each of the process cartridges 1Y, 1M, 1C, and 1Bk different in the development color, is removably mountable in the main assembly 2 of the image forming apparatus 100, through the process cartridge mounting means 50 of the main assembly 2. In this embodiment, the frame of the process cartridge 1 comprises the waste toner container 14*b* and developer container 20, which are integrally joined with each other. The toner container 14*b* supports the photosensitive drum 10, charge roller 11, and cleaning blade 17, whereas the developer container 20 supports the development roller 16, development blade 17, toner supply roller 18, and stirring blade 19.

However, the design of the process cartridge 1 does not need to be limited to the above described one. For example, the developing apparatus 13 may be immovably attached to the main assembly 2 of an image forming apparatus, while a photosensitive member as an image bearing member, and a minimum of one means among a charging means for charging the photosensitive member, a developing means for supplying the photosensitive member with developer, and a cleaning means for cleaning the photosensitive member, are integrally disposed in a cartridge which is removably mountable in the main assembly of an image forming apparatus. On the other hand, only the developing apparatus 13 may be placed in a cartridge, effecting a development cartridge removably mountable in the image forming apparatus main assembly 2.

In this embodiment, as the process cartridge 1 is mounted into the image forming apparatus main assembly 2, the driving force transmitting means of the process cartridge 1 becomes connected with the driving means (unshown) of the image forming apparatus main assembly 2, making it possible to drive the photosensitive drum 10, developing apparatus 13, charge roller 11, etc. The power sources for applying voltage to the charge roller 11, development roller 16, development blade 17, etc., are provided on the image forming apparatus main assembly 2 side, and become connected, in terms of electricity conduction, with the charge roller 11, development roller 16, is development blade 17, etc., respectively, through the contact points provided on the process cartridge 1 side and the contact points provided on the image forming apparatus main assembly 2 side, as the process cartridge 1 is mounted into the image forming apparatus main assembly 2.

Further, in this embodiment, the power sources (blade bias power source, development bias power sources, primary transfer bias power sources, secondary transfer bias power source, and charge bias power sources), with which the image forming apparatus 100 is provided, are controlled by a CPU 60 (FIG. 3), as a controlling means, for integrally controlling the overall operation of the image forming apparatus. Also in this embodiment, as will be described later, the CPU 60 as a controlling means controls the development bias power source 23 with the predetermined timing, based on the values stored in advance in the storage portion of the CPU 60, for example; in other words, the CPU 60 functions as a means for switching the development bias.

Next, the switching between the full-color mode and monochromatic mode will be described.

The image forming apparatus in this embodiment has the full-color print mode (first mode) in which a full-color image is formed by using all the image formation stations, and the monochromatic print mode (second mode) in which a monochromatic image, in particular, a black image, is formed using only one (for example, black one to form a black image) of the image formation stations.

Figure 3:
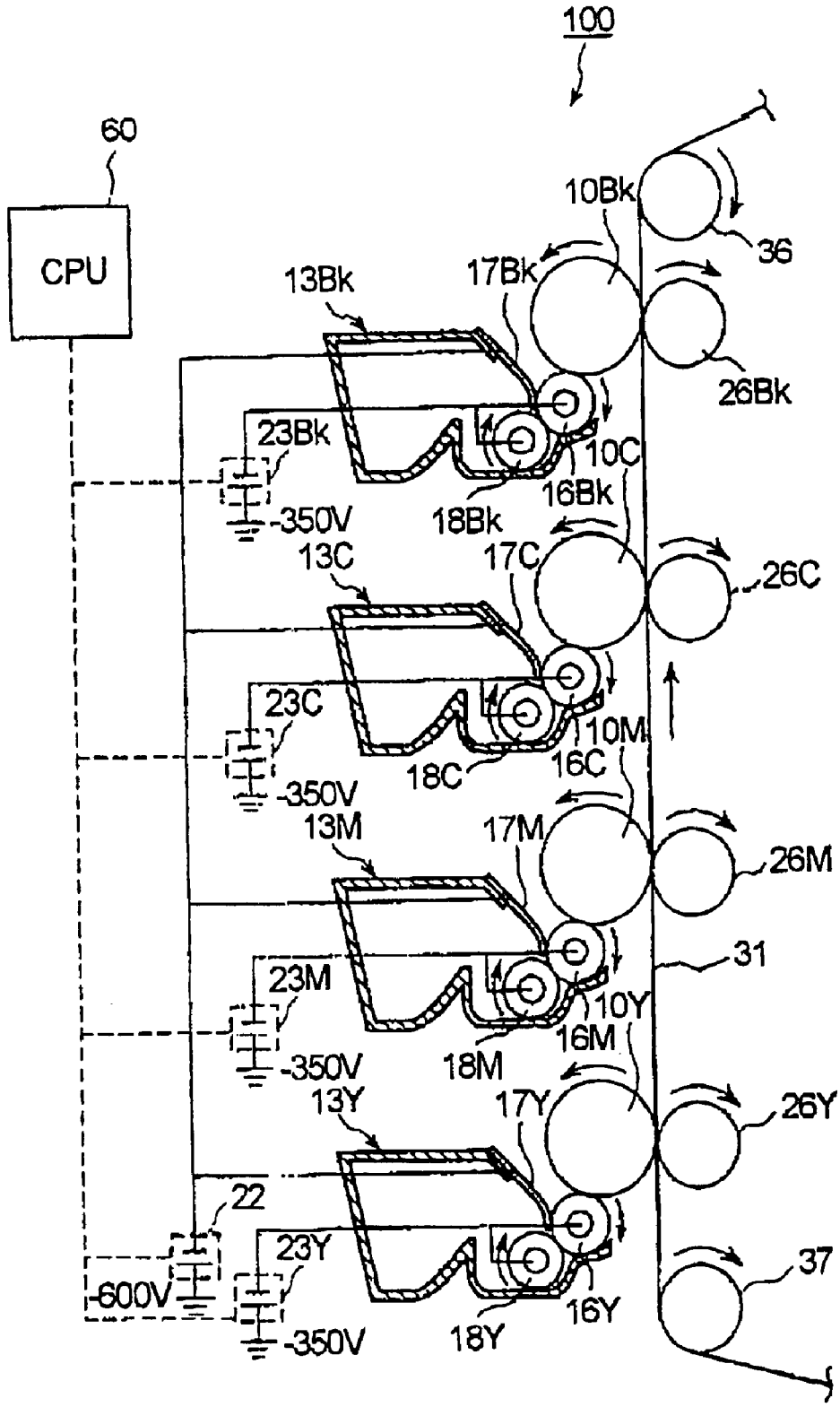
FIG. 3 is a schematic sectional view of the image forming apparatus in FIG. 1, for showing the state thereof when the apparatus is in the full-color print mode.
Figure 4:
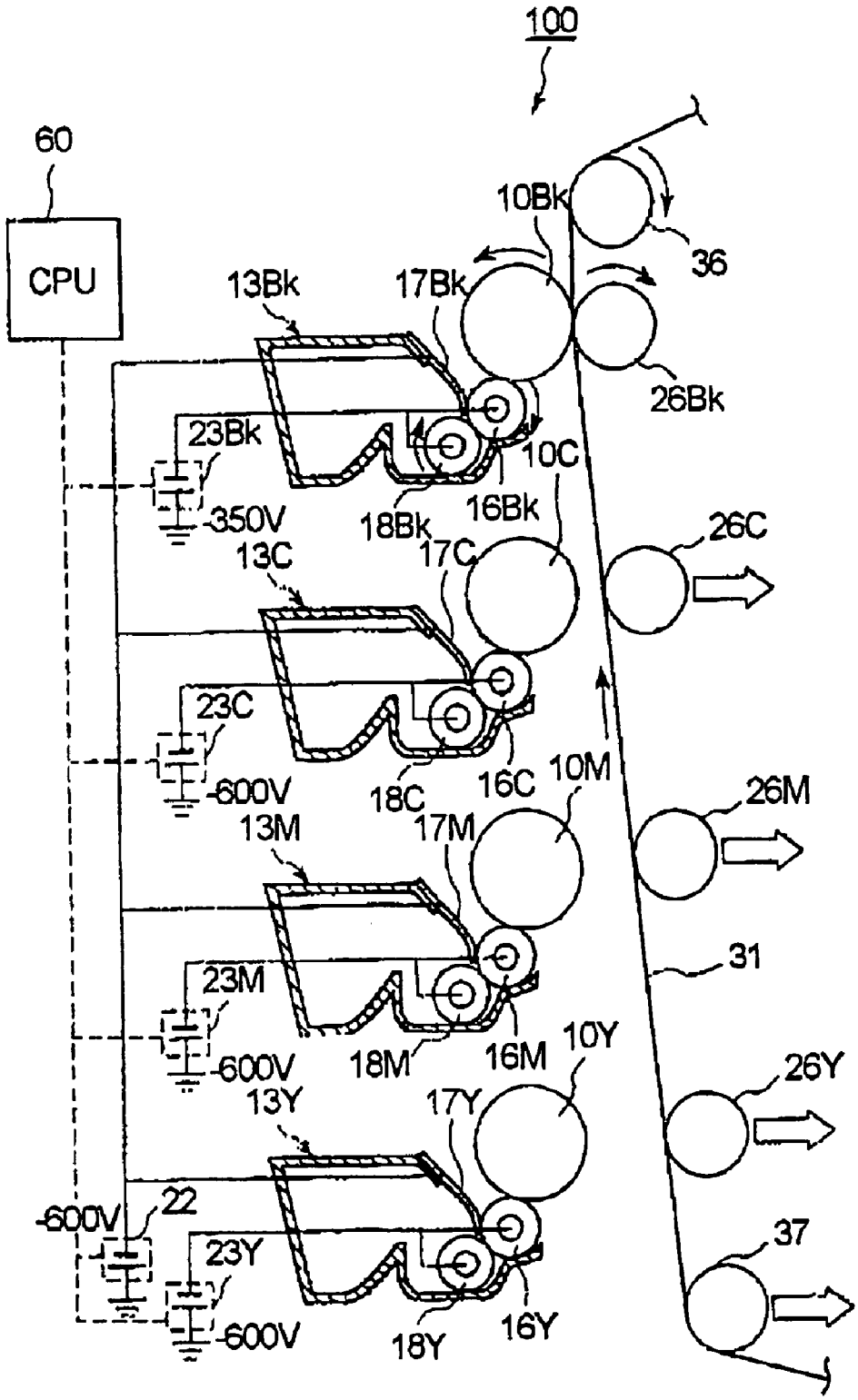
FIG. 4 is a schematic sectional view of the image forming apparatus, showing the state thereof when the apparatus is in the monochromatic print mode.

FIGS. 3 and 4 are schematic sectional views of the essential portion, in particular, the portion comprising the photosensitive drums 10, developing apparatuses 13, primary transfer rollers 26, intermediary transfer belt 31, etc., of the image forming apparatus. In FIGS. 3 and 4, the components other than the listed ones are not shown.

Referring to FIG. 3, the intermediary transfer belt 31 is suspended by the driving roller 36 and switching roller 37. The switching roller 37 is movable toward, or away from, the yellow developing apparatus 13Y, that is, the bottommost developing apparatus, by a moving means (unshown).

FIG. 3 shows the state of the essential portion of the image forming apparatus in the full-color print mode. In this mode, the switching roller 37 is positioned closer to the yellow developing apparatus 13, or the bottommost developing apparatus, more specifically, close enough for all four primary transfer rollers 26Y, 26M, 26C, and 26Bk to be kept pressed against the photosensitive drums 10Y, 10M, 10C, and 10 Bk, respectively, with the interposition of the intermediary transfer belt 31. Further, in each of the four image formation stations PY, PM, PC, and PBk, the photosensitive drum 10, development roller 16, toner supply roller 18, and primary transfer roller 26, are driven in the directions indicated, respectively, by arrow marks in the drawing.

FIG. 4 shows the state of the essential portion of the image forming apparatus in the monochromatic print mode. In this mode, the switching roller 37 is moved a predetermined distance away from the position in which it is positioned in the full-color print mode, in the direction (direction indicated by arrow marks in drawing) to move away from the yellow developing apparatus 13, by a distance large enough to keep the primary transfer rollers 26Y, 26M, and 26C for yellow, magenta, and cyan color components, respectively, away from the photosensitive drums 10Y, 10M, and 10C, respectively. Thus, in this mode, the intermediary transfer belt 31 does not contact the photosensitive drum 10Y, 10M, and 10C, in the image formation stations PY, PM, and PC, respectively, in each of which the photosensitive drum 10, development roller 16, toner supply roller 18, and primary transfer roller 26 are not driven, being therefore spared from the deterioration which would results from being unnecessarily driven. Further, not driving the development rollers 16 and toner supply rollers 18 when in this mode prevents the toner deterioration associated with the rotation of the development rollers 16 and toner supply rollers 18.

In this embodiment, the CPU 60 as the controlling means has the functions of controlling the movement of the switching roller 37, and the driving (starting or stopping) or the photosensitive drums 10, development rollers 16, toner supply rollers 18, and primary transfer rollers 16, in the image formation stations. More specifically, the CPU 60 switches the operational mode of the image forming apparatus by turning on or off the means for moving the switching roller 37 with a predetermined timing, turning on or off the means for driving the photosensitive drum 10, development roller 16, toner supply roller 18, and primary transfer roller 26 in each of the image formation stations, connecting or disconnecting the driving force transmitting means, for example, clutches, for the photosensitive drum 10, development roller 16, toner supply roller 18, and primary transfer roller 26 in each of the image formation stations, and/or carrying out the like operations. In other words, the CPU 60 switches the operational mode of the image forming apparatus by using ordinary methods which are easily understandable by the professionals in the field of this business.

Figure 10:
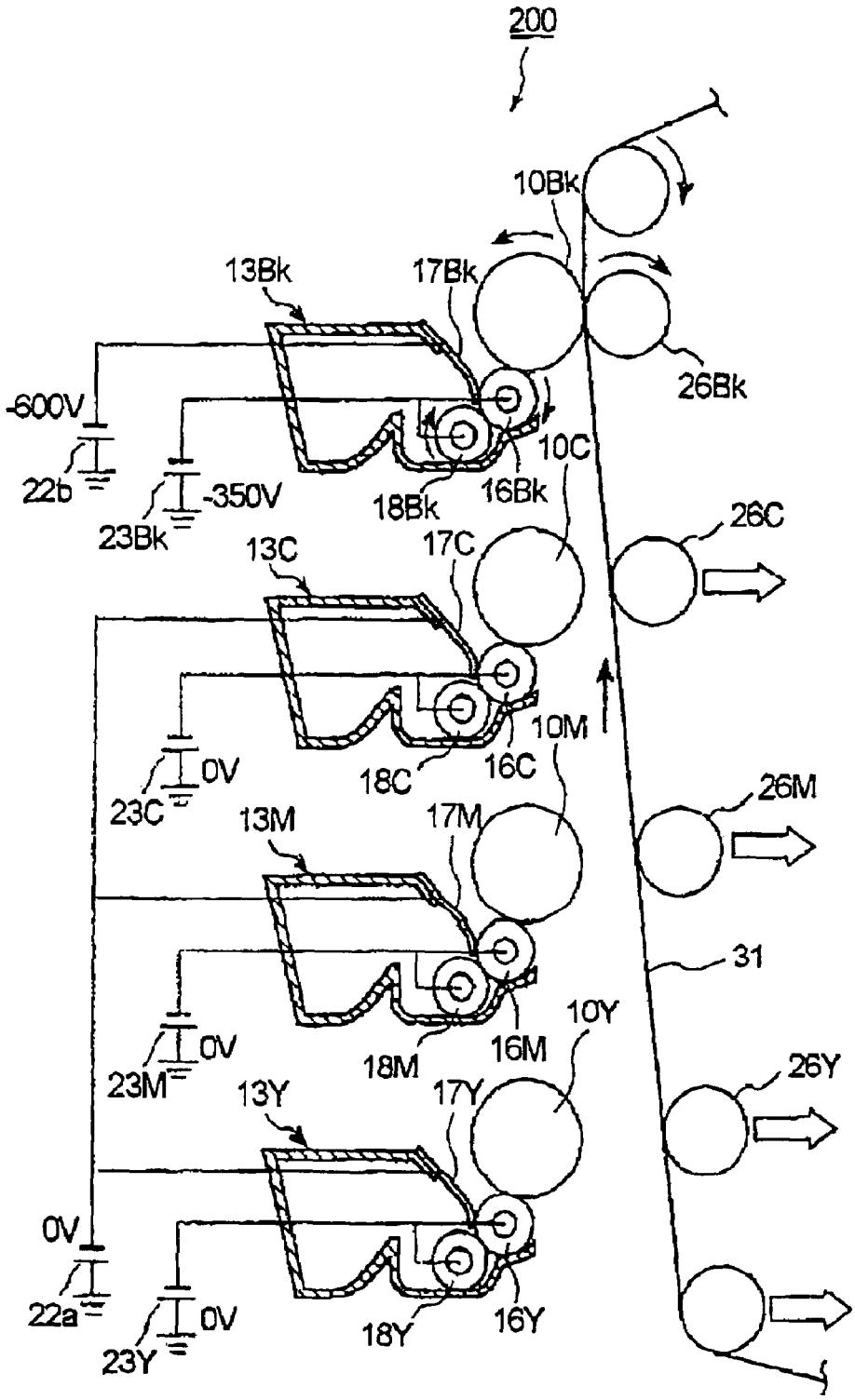
FIG. 10 is a schematic sectional view of the image forming apparatus in FIG. 8, showing the state thereof when the apparatus is in the monochromatic print mode.

In comparison, when an image forming apparatus, such as the one (comparative apparatus) shown in FIG. 10, in accordance with the prior arts, which comprises a first blade bias power source 22*a*, as a voltage application means, for applying blade bias to the development blades 17Y, 17M, and 17C in the yellow, magenta, and cyan image formation stations PY, PM, and PC, respectively, and a second blade bias power source 22*b* for applying blade bias to the development blade 17Bk in the black image formation station PBk, is in the monochromatic mode, both the power sources for the development rollers 16 and development blades 17 in the yellow, magenta, and cyan image formation stations are turned off.

With the biases to be applied from the power sources 22*a* and 22*b* to the development rollers 16 and development blade 17 reduced in potential level to 0 V, the above-described solid toner adhesion to the development blade 17 kept in contact with the stationary development roller 16, does not occur.

However, providing an image forming apparatus with the first and second blade bias power sources 22*a* and 22*b* as shown in FIG. 10 has the aforementioned shortcomings, that is, the increase in electric circuit board size, apparatus cost, etc.

Thus, in this embodiment, the image forming apparatus is designed so that a single blade bias power source (power source 22), or a common power source, can be shared by the four image formation portions, in consideration of the above problems, in other words, in order to minimize the apparatus size well as apparatus cost. This design, however, suffers from its own problem when the image forming apparatus is in the monochromatic print mode. That is, if there is only a single blade bias power source, or the blade bias power source 22, the bias is applied to both the development blade 17 and development roller 16 in each of the yellow, magenta, and cyan image formation stations, PY, PM, and PC, while the image forming apparatus in the monochromatic mode, in which the development roller 16 is not rotated.

In other words, if an image forming apparatus provided with only one blade bias power source, which is shared by all the image formation stations, in the monochromatic mode, bias is applied to the development blades 17 in the yellow, magenta, and cyan image formation stations PY, PM, and PC, even though the development rollers 16 are not rotating.

Thus, the toner particles which happen to be between the development roller 16 and development blade 17 when the image forming apparatus is switched in operational mode become stuck in the nip between the development roller 16 and development blade 17, being therefore deteriorated by the electric current which flows between the development roller 16 and development blade 17, which is likely to cause the toner particles to solidly adhere to the development blade 17.

More concretely, in the monochromatic print mode, the potential level of the bias to be applied to the development blade 17Bk in the black image formation station PBk is desired to be −600 V. That is, the potential level of the development blade 17Bk is desired to be increased in absolute value while being kept the same in polarity as the toner so that the toner is pulled toward the development roller 16Bk. This creates the following problem. That is, if the potential levels of the development biases applied to the development rollers 16Y, 16M, and 16C in the three (yellow, magenta, and cyan) image formation stations PY, PM, and PC, that is, the rest of the image formation stations, are reduced to 0 V, there occurs a difference in potential level of 600 V, between the development rollers 16Y, 16M, and 16C, and development blades 17Y, 17M, and 17C, respectively, causing the toner particles remaining stuck between the development roller 16Y, 16M, and 16C, and the development blades 17Y, 17M, and 17C to be deteriorated by the electric current.

Thus, in this embodiment, when an image forming apparatus is in the monochromatic print mode, the potential level of the bias to be applied to the development blade of the black developing apparatus 13Bk, that is, a specific developing apparatus, which is kept active, is set so that the difference in potential level between the bias to be applied to the development roller 16 and the bias to be applied to the development blade 17 in each of the developing apparatuses 13Y, 13M, and 13C, which is kept inactive, becomes smaller than the difference in potential level between the bias to be applied to the development roller 16 and development blade 17 in the black developing apparatus 13Bk, or the specific developing apparatus. In other words, the voltages to be applied to the development rollers 16Y, 16M, and 16C which are not rotated are controlled so that the difference in potential levels between the development rollers 16Y, 16M, and 16C which are not rotated, and the development blades 17Y, 17M, and 17C, respectively, become smaller than the difference in potential level between the development roller 16Bk which is rotated, and the development blade 17Bk.

In this embodiment, as an image forming apparatus is switched from the full-color print mode to the monochromatic print mode, the biases to be applied to the development rollers 16Y, 16M, and 16C in the three color (yellow, magenta, and cyan) image formation stations PY, PM, and PC are increased in potential level from −350 V (first bias level), which is the potential level while the image formation stations are active, to −600 V (second bias level).

Summarized in the following tables (Tables 1 and 2) are the relationships among the full-color and monochromatic print modes, the potential level values of the biases to be applied to the development roller 16 and development blade 17 in the black image formation station PBk, the potential level values of the biases to be applied to the development rollers 16 and development blades 17 in the three color (yellow, magenta, and cyan) image formation stations. Table 1 shows the relationships in the image forming apparatus in this embodiment, and Table 2 shows the relationships in the comparative image forming apparatus, or the image forming apparatus in accordance with the prior art.

TABLE 1

EMBODIMENT

| DEV. | FULL CLR | | MONO. | |
|---|---|---|---|---|
| DEVICE | DEV. RLR | DEV. BLD | DEV. RLR | DEV. BLD |
| Bk | −350 V | −600 V | −350 V | −600 V |
| Y.M.C. | −350 V | | −600 V | |

TABLE 2

COMPARISON EX.

| DEV. | FULL CLR | | MONO. | |
|---|---|---|---|---|
| DEVICE | DEV. RLR | DEV. BLD | DEV. RLR | DEV. BLD |
| Bk | −350 V | −600 V | −350 V | −600 V |
| Y.M.C. | −350 V | −600 V | 0 V | 0 V |

Referring to Table 1, in this embodiment, when the image forming apparatus is in the monochromatic mode, the biases to be applied to the development rollers 16Y, 16M, and 16C in the three color (yellow, magenta, and cyan) image formation stations which are kept inactive in the monochromatic mode, are set to 600 V, which is equal to the potential level of the biases to be applied to the development blades 17Y, 17M, and 17C.

This arrangement, therefore, eliminates the difference in potential level between the development blades 17 and corresponding development rollers 16, stopping thereby current flow between the development blades 17 and corresponding development rollers 16. Thus, the toner particles in the nip between the development blades 17 and corresponding development rollers 16 are not deteriorated by the electric current, and therefore, do not solidly adhere to the development blades 17, in the nips between the development blades 17 and corresponding development rollers 16.

The following is the discovery made through the extensive studies made by the inventors of the present invention; when an image forming apparatus is in the monochromatic print mode, if the difference in potential level between the bias applied to the development blade 17, and the bias applied to the development roller 16 (which is not being rotated) in a given developing apparatus 13 which is not active, exceeds 300 V, the solid toner adhesion sometimes occurs. Next, the studies made by the inventors will be described in more detail.

The results of the tests carried out during the studies are given in the following tables (Tables 3, 4, and 5). In the tests, the image forming apparatus 100 in this embodiment is used while varying the amount of the difference in potential level between the development blade 17 and development roller 16, and the solid toner adhesion to the development blade 17 was observed, while evaluating the extent of the solid toner adhesion in terms of the quality of the images outputted by the apparatus 100. In the tables, "o" means "excellent" in that no solid toner adhesion occurred and images had no unwanted streaks; "Δ" means "slightly bad" in that toner had solidly adhered only in the form of a minute granule, and yet, images had no visible unwanted streaks; and "x" means "bad" in that toner had solidly adhered in the form of a larger granule, and images had pronounced unwanted streaks. Also in the tests, the length of time the three color image formation stations PY, PM, and PC were kept inactive (length of time current was flowed between development roller 16 and development blade 17 without rotating development roller 16) was set to 30, 60, and 90 minutes, the results of which are given in Tables 3, 4, and 5, respectively.

As will be evident from the results given in Tables 3, 4, and 5, the longer the current flowed with the development roller 16 not being rotated, the worse the solid toner adhesion.

Therefore, it is evident that when it is expected that a given printing job will require an image forming apparatus to be continuously driven for roughly 60 minutes, the amount of the difference in potential level between the development roller 16 and development blade 17 is desired to be set to a value no more than 300 V, whereas when it is expected that a given printing job will require the image forming apparatus to be continuously driven for roughly 90 minutes, the amount of the difference is desired to be set to a value no more than 200 V. The smaller the amount of this difference, the better; it may be 0 V as in this embodiment.

As described above, according to this embodiment, when an image forming apparatus is in the monochromatic print mode, the amount of the difference in potential level between the development roller 16 (which is not rotated in monochromatic mode) and development blade 17 in a given developing apparatus 13 which is not activated in the monochromatic mode, is smaller than that in an image forming apparatus in accordance with the prior arts. Therefore, the toner particles remaining sandwiched between the development roller 16 and development blade 17 do not solidly adhere to the development blade 17, and therefore, the unwanted streaks associated with the solid toner adhesion to the development blade 17 do not occur. Also according to this embodiment, in the monochromatic print mode, bias can be applied to even the development blade 17 of any of the developing apparatuses 13 which are not activated in the monochromatic mode, requiring therefore only one development blade power source even if the image forming apparatus is provided with two or more developing apparatuses 13.

TABLE 3

| | TONER SOLIDIFICATION (30 Min.) | | | | | | | |
|---|---|---|---|---|---|---|---|---|
| | POT. DIF. | | | | | | | |
| | 0 V | 100 V | 200 V | 300 V | 400 V | 500 V | 600 V | 700 V |
| RLR STOP | ○ | ○ | ○ | ○ | Δ | X | X | X |

TABLE 4

| | TONER SOLIDIFICATION (60 Min.) | | | | | | | |
|---|---|---|---|---|---|---|---|---|
| | POT. DIF. | | | | | | | |
| | 0 V | 100 V | 200 V | 300 V | 400 V | 500 V | 600 V | 700 V |
| RLR STOP | ○ | ○ | ○ | Δ | X | X | X | X |

TABLE 5

| | TONER SOLIDIFICATION (90 Min.) | | | | | | | |
|---|---|---|---|---|---|---|---|---|
| | POT. DIF. | | | | | | | |
| | 0 V | 100 V | 200 V | 300 V | 400 V | 500 V | 600 V | 700 V |
| RLR STOP | ○ | ○ | Δ | X | X | X | X | X |

In this case, if a bias of −600 V is applied to the stationary development roller 16, the toner particles in the nip between the stationary photosensitive drum 10 and development roller 16 remain attracted toward the photosensitive drum 10. Thus, if the photosensitive drum 10 begins to be rotated in this state, the toner particles in the nip remain on the peripheral surface of the photosensitive drum 10, forming a straight stripe which extends in the lengthwise direction of the photosensitive drum 10. If the amount by which the toner particles are transferred onto the peripheral surface of the photosensitive drum 10 because of the above described reason is substantial, there is the possibility that the transferred toner particles soil the transfer medium S, or the final transfer medium, by way of the intermediary transfer bell 31, or the intermediary transfer medium.

Figure 5:
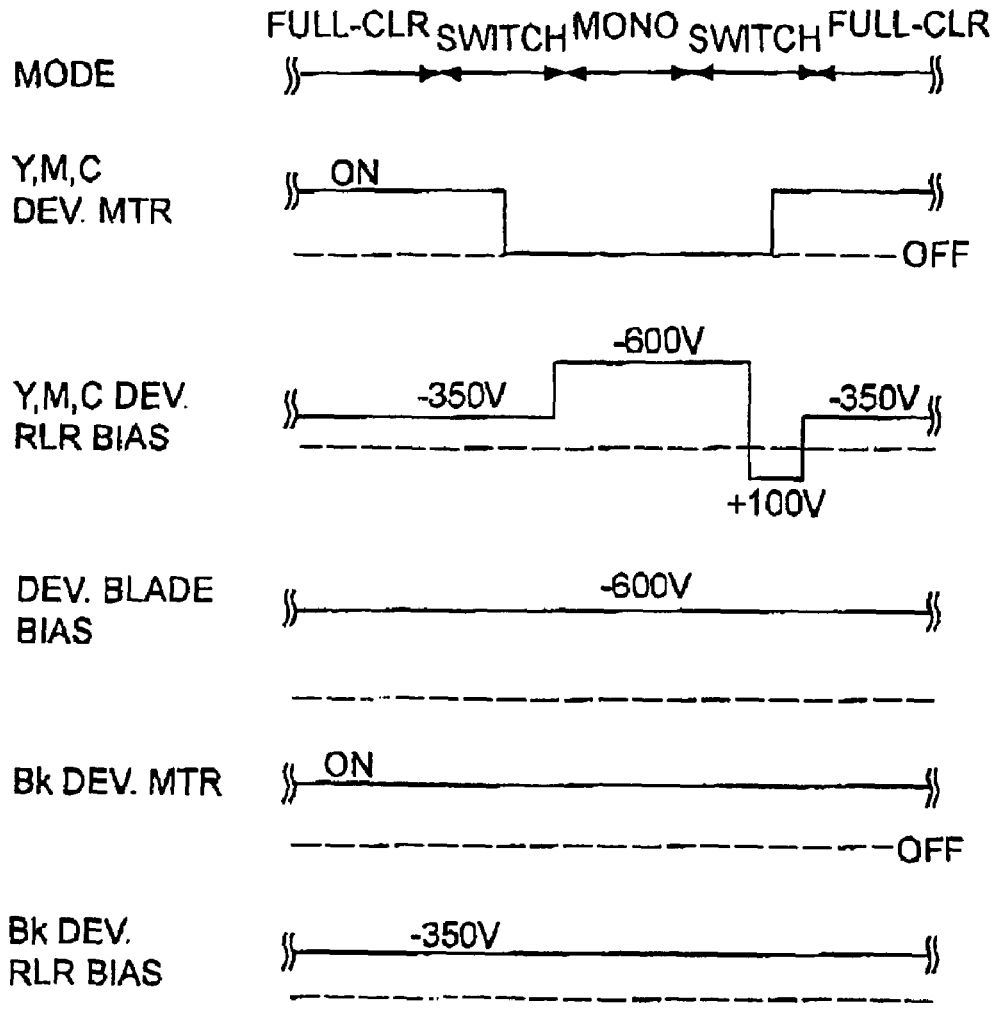
FIG. 5 is a drawing for showing one example of a sequence for switching the operational mode of the image forming apparatus between the full-color print mode and monochromatic mode.

In this embodiment, therefore, prior to switching back to the full-color print mode from the monochromatic print mode, the bias to be applied to the development roller 16 in each of the image formation stations which have been kept inactive is switched to the bias capable of returning the toner particles to the development roller 16. In other words, before reactivating any of the plurality of temporarily inactivated developing apparatuses 13, the potential levels of the biases to be applied to the development blades in the image formation stations, which have been kept inactive, are temporarily shifted in the direction opposite in polarity to the toner polarity, and then, they are set to the values for the active status (values for image formation). FIG. 5 shows this sequence.

In this embodiment, in the monochromatic print mode, a bias of −600 V was continuously applied to the development rollers 16 and development blades 17 of the developing apparatuses 13Y, 13M, and 13C which were kept inactive. However, prior to switching back from the monochromatic print mode to the full-color print mode, a bias (third bias) of +100 V was temporarily applied to the development rollers 16 and development blades 17 in the developing apparatuses 13Y, 13M, and 13C. With the application of this bias, the toner particles were pulled back to the development rollers 16, reducing thereby the amount by which the toner particles were transferred onto the photosensitive drums 10, in the pattern of a straight stripe extending in the lengthwise direction of the photosensitive drum 10.

As for the potential level of the peripheral surface of the photosensitive drum 10, it gradually attenuates from −600 V until it finally converges to 0 V. Thus, if it is on the positive side relative to 0 V, this bias can pull the toner toward the development roller 16 from the photosensitive drum 10. Although there are exceptions, in order to effectively attract the toner particles by the development roller 16, the amount of the difference in potential level between the development roller 16 and photosensitive drum 10 is desired to be in the range of 0 V–200 V, preferably, the range of 100 V–200 V.

Thereafter, that is, in the full-color mode, the bias to be applied to the development roller 16 is reset to −350 V before starting a printing operation.

As described above, according to the bias control in this embodiment, the solid toner adhesion to the development blade 17, which occurs in the image formation stations other than a specific image formation station kept active to form a monochromatic image, while the image formation stations other than the specific image formations are kept inactivated, can be prevented to prevent the formation of an image having unwanted developmental streaks associated with the solid toner adhesion to the development blade 17, without providing the specific image formation station with a blade bias power source independent from the blade bias power source (or sources) for the other image formation stations, in other words, without increasing the number of the development bias power sources.

Also according to this embodiment, when reactivating the developing apparatus 13 which has been kept inactive, such bias that causes the toner to move to the development roller 16 is applied to the development roller 16, minimizing thereby the amount by which the toner is transferred onto the photosensitive drum 10 in the pattern of a straight stripe, eliminating thereby the possibility that the toner particles, which were trapped in the nip between the development roller 16 and development blade 17 of the image formation station other than a specific image formation station kept activated for the formation of a monochromatic image, soil the back side of the transfer medium S by transferring onto it by way of the intermediary transfer belt 31.

Embodiment 2

Next, another embodiment of the present invention will be described. The image forming apparatus in this embodiment is identical in base structure and operation. Therefore, the components in this apparatus which are identical in structure and function to those in the first embodiment will be given the same referential symbols as those given in the first embodiment, and will not be descried in detail at this time.

Figure 6:
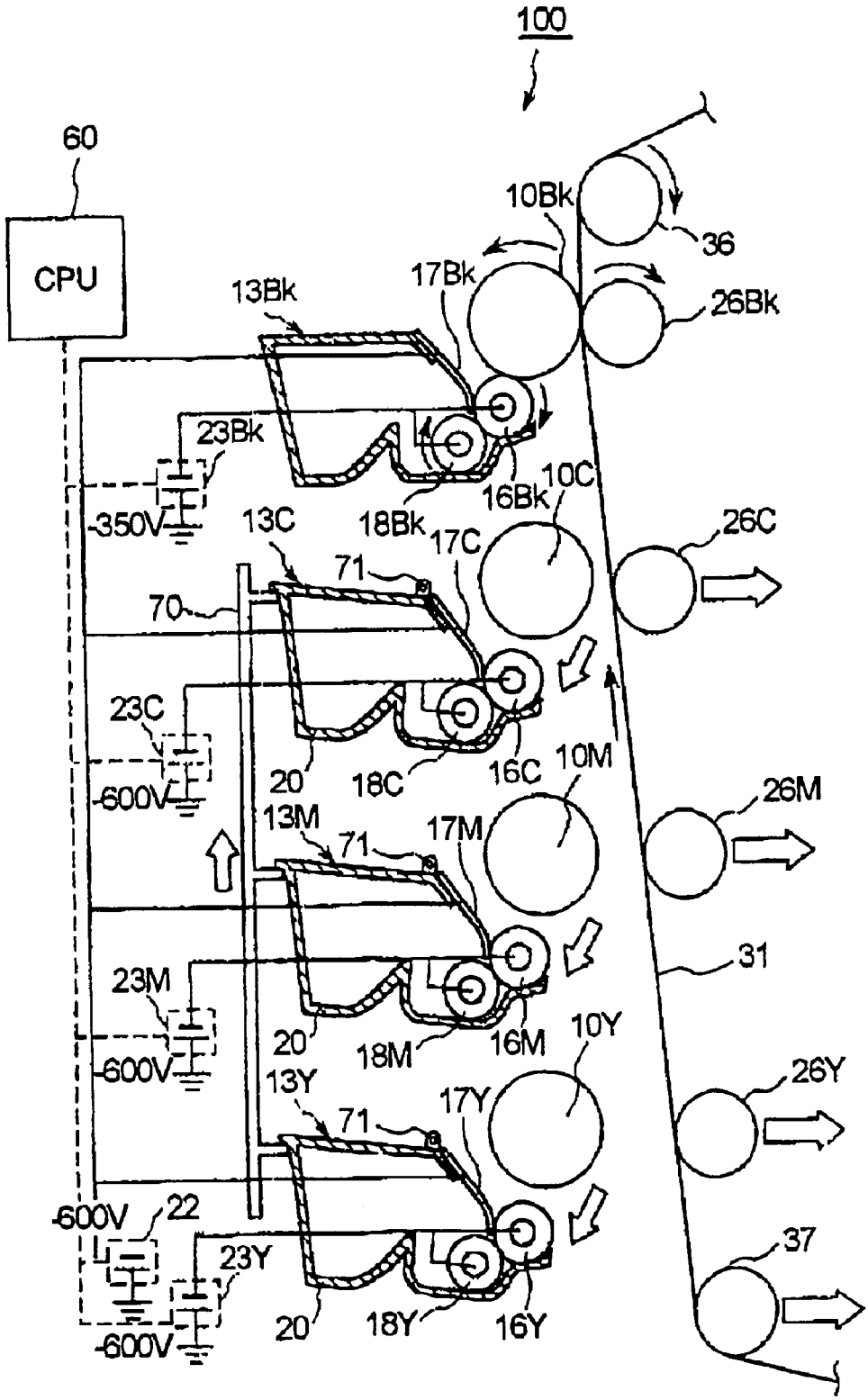
FIG. 6 is a schematic sectional view of the image forming apparatus in another embodiment of the present invention, for showing the state thereof when the apparatus is in the monochromatic print mode.

FIG. 6 is a schematic sectional view of the essential portion, in particular, the portion comprising the photosensitive drums 10, developing apparatuses 13, primary transfer rollers 26, and intermediary transfer belt 31, of the image forming apparatus in this embodiment in the monochromatic print mode. As will be evident from the drawing, in the monochromatic print mode, the photosensitive drum 10, development roller 16, toner supply roller 18, and primary transfer roller 26 in each of the yellow, magenta, an cyan image formation stations PY, PM, and PC are kept stationary, and bias is continuously applied to development blade 17 and development roller 16 in each of the yellow, magenta, and cyan image formation stations PY, PM, and PC, as in the first embodiment.

In other words, the image forming apparatus in this embodiment also is minimized in size and cost by being provided with only a single development blade power source. Thus, in each of the three color (yellow, magenta, and cyan) image formation stations PY, PM, and PC, blade bias is continuously applied to both the development blade 17 and development roller 16 even while these image formation stations are kept inactive, that is, even while the image forming apparatus is in the monochromatic print mode (black printing mode), as in the first embodiment.

More concretely, in the monochromatic print mode, a bias of −600 V needs to be continuously applied to the development blade 17Bk of the black image formation station PBk. However, if the biases to be applied to the development rollers 16Y, 16M, and 16C of the rest of the image formation stations, that is, the three color (yellow, magenta, and cyan) image formation stations PY, PM, and PC are reduced in potential level to 0 V while simply continuously applying the bias of −600 V to the development blade is 17Bk, a potential level difference of 600 V is created between the development rollers 16Y, 16M, and 16C, and the development blades 17Y, 17M, and 17C, respectively, causing the toner particles stuck between these development rollers 16Y, 16M, and 16C, and development blades 17Y, 17M, and 17C, respectively, to be deteriorated by the electric current.

Thus, the biases to be applied to the development rollers 16 in the three color (yellow, magenta, and cyan) image formation stations PY, PM, and PC which are inactive, is increased in potential level from −350 V (first bias level), which is to be applied to development roller 16 during image formation, to −600 V (second bias level).

On the other hand, as in the first embodiment, the bias of −600 V is continuously applied to the development rollers 16 which are kept inactive. Therefore, if the development rollers 16 remain in contact with the corresponding photosensitive drums 10, the toner particles stuck in the nip between the development roller 16 and development blade 17 in each of the inactive image formation stations are attracted to the photosensitive drum 10 therein, forming a straight stripe on the photosensitive drum 10.

Thus, in this embodiment, in the monochromatic print mode, the development rollers 16Y, 16M, and 16C are moved away in the direction indicated by the arrow marks in FIG. 6 from the photosensitive drums 10Y, 10M, and 10C, in the yellow, magenta, and cyan image formation stations PY, PM, and PC, respectively, following a sequence which will be described next.

Figure 7:
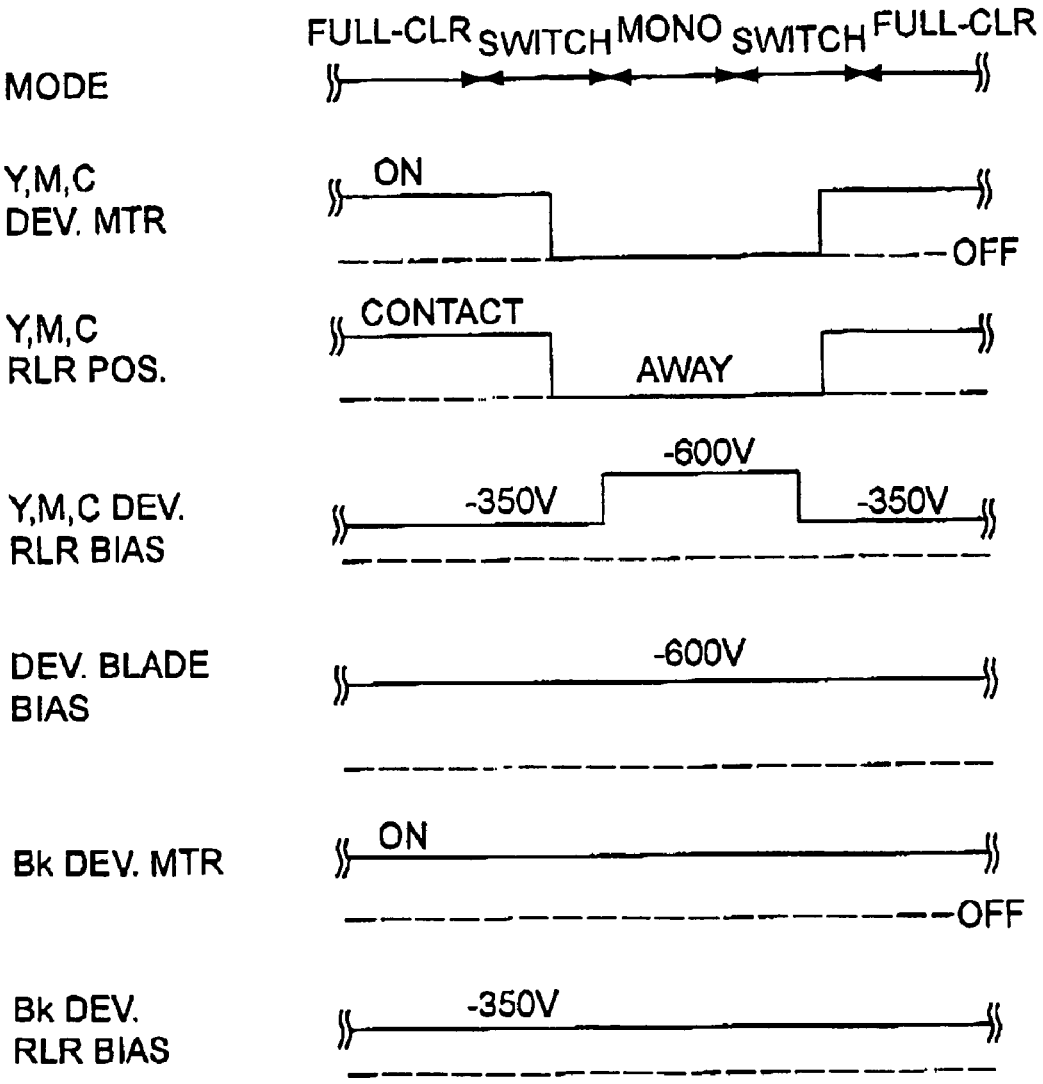
FIG. 7 is a drawing for showing one example of a sequence for switching the operational mode of the image forming apparatus in another embodiment of the present invention, between the full-color print mode and monochromatic mode.

FIG. 7 shows the aforementioned separation sequence. Immediately prior to beginning to continuously apply the bias of −600 V to the development roller 16 and development blade 17 in each of the yellow, magenta, and cyan image formation stations PY, PM, and PC which are inactive, the development roller 16 in each of the yellow, magenta, and cyan image formation stations PY, PM, and PC is separated from the corresponding photosensitive drum 10. Then, when switching back to the full-color print mode from the monochromatic print mode, the development rollers 16 are placed in contact with the corresponding photosensitive drums 10 after the potential level of the bias to be applied to the development roller 16 in each of the yellow, magenta, and cyan image formation stations PY, PM, and PC which were kept inactive is switched back to −350 V. During this period, the surface potential level of each photosensitive drum 10 is kept at the predetermined level, or −600 V, preventing therefore the toner particles from transferring onto the photosensitive drum 10.

With the above arrangement, it does not occur that the toner particles having stuck in the nip between the development roller 16 and development blade 17 in the monochromatic mode transfer onto the photosensitive drum 10, in the pattern of a straight stripe, and therefore, it does not occur that the transfer medium is soiled by these toner particles.

As for the method for separating the development rollers 16 from the corresponding photosensitive drums 10, the following method, for example, may be employed. That is, the developer container 20, which is a part of the process cartridge 1 and is pivotally connected to the waste toner container 14*b* which supports the photosensitive drum 10, is pivoted about an axis 71 by a separating means 70 movable in the forward or backward direction by a driving means (unshown) with which the image forcing apparatus main assembly 2 is provided. In this embodiment, the movement of the separating means 70 is controlled by the CPU 60 as a controlling means. The present invention, however, does not limit the choice of the means for separating the development roller 16 from the photosensitive drum 10 to the above described separating means. In other words, any separating means among those taken into consideration by the professionals in the field of this business may be employed for the same purpose. In terms of design, such a modification falls within the scope of the present invention.

Keeping the development roller 16 in each of the inactivated image formation stations, separated from the photosensitive drum 10, in the monochromatic print mode, and, and placing the development roller 16 having been kept separated from the photosensitive drum in the monochromatic print mode, back in contact with the photosensitive drum 10, in the full-color print mode, can prevent the problem that if the voltage applied as blade bias to the development blade 17 in an inactive image formation station is identical in potential level to that applied as the development bias to the development roller 16, the toner particles trapped between the development roller 16 and photosensitive drum 10 transfer onto the photosensitive drum 10 in the pattern of a straight stripe, preventing thereby the problem that the transfer medium is soiled by these toner particles.

In summary, according to this embodiment, as in the first embodiment, the solid toner adhesion to the development blade 17, which occurs in the image formation stations other than a specific image formation station kept active to form a monochromatic image, while the image formation stations other than the specific image formations are kept inactivated, can be prevented to prevent the formation of an image having unwanted developmental streaks associated with the solid toner adhesion to the development blade 17, without providing the specific image formation station with a blade bias power source independent from the blade bias power source (or sources) for the other image formation stations, in other words, without increasing the number of the development bias power sources.

Also according to this embodiment, in the monochromatic print mode, the development roller 16 in each of the image formation stations other than a specific image formation station to be used for the formation of a monochromatic image is kept separated from the photosensitive drum 10, whereas in the full-color print mode, it is kept in contact with the photosensitive drum 10. Therefore, the toner particles stuck in the nip between the development roller 16 and development blade 17 in each of the inactive image formation stations do not transfer onto the photosensitive drum 10 therein, in the pattern of a straight stripe, eliminating the possibility that such toner particles transfer onto the back side of the transfer medium S, soiling it, by way of the intermediary transfer belt 31.

Incidentally, the preceding embodiments of the present invention were described with reference to the image forming apparatuses which employed an intermediary transfer medium. However, as has been known by the professionals in the field of this business, the present invention is also applicable to a full-color image forming apparatus which comprises a transfer medium bearing member, instead of an intermediary transfer medium, and in which the toner images from the image formation stations are sequentially transferred in layers onto the final transfer medium which is being conveyed through the image formation stations, being borne on the transfer medium bearing member; the final transfer medium is separated from the transfer medium bearing member; and the unfixed toner images on the final transfer medium ate fixed.

According to the present invention, an image forming apparatus capable of keeping stationary some of its developer bearing members has only to be provided with a single development bias power source, and this development bias power source can be shared by all the developer regulating members in the image forming apparatus, eliminating the need for multiple development bias power sources. In addition, the solid developer adhesion to the developer regulating member, which occurs in the image formation stations other than a specific image formation station being used for forming a monochromatic image when the image forming apparatus is in the monochromatic mode, can be prevented, preventing thereby the formation of an image having unwanted streaks associated with the solid developer adhesion to the development blade. Also according to the present invention, a single high voltage power source can be shared, as a development bias power source, by all the development rollers in an image forming apparatus employing a contact developing method. In other words, the number of the high voltage power sources as a development bias power source, which an image forming apparatus employing a contact developing method requires, can be reduced to one, making it possible to reduce the apparatus in size and cost, while preventing the solid developer adhesion to the developer regulating members, formation of an image having unwanted streaks associated therewith, as well as soiling of the back side of the final transfer medium associated with therewith.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a plurality of developing devices each including a developer carrying member for carrying a developer to develop an electrostatic latent image formed on an image bearing member, and a developer regulating member for regulating the developer carried on said developer carrying member;

common voltage applying means for applying a common voltage to said plurality of developer regulating members, wherein when a first one of said developer carrying members is rotating, and when a second one of said developer carrying members is not rotating, a potential difference between a potential of said second developer carrying member and said common voltage is smaller than a potential difference between a potential of said first developer carrying member and said common voltage.

2. An apparatus according to claim 1, wherein said image forming apparatus is selectively operable in a first image formation mode in which said first and second developer carrying members are rotated, and in a second image formation mode in which said first developer carrying member is rotated, and said second developer carrying member is not rotated.

3. An apparatus according to claim 1, wherein voltages applied to said developer carrying members are variable independently from each other.

4. An apparatus according to claim 1, wherein at least during operations of said plurality of developing devices, voltages are applied to said developer carrying members, and said developer carrying members are supplied with common voltages by said voltage applying means.

5. An apparatus according to claim 1, wherein voltages applied to said developer carrying members are respectively variable in accordance with results of detections of densities of reference images formed using respective developer carrying members.

6. An apparatus according to claim 1, wherein when said second developer carrying member starts to rotate, said second developer carrying member is supplied with a voltage which is closer to a voltage opposite from a charge polarity of the developer than the voltage applied during the developing operation, before said second developer carrying member is supplied with a voltage which is to be applied during the developing operation.

7. An apparatus according to claim 1, wherein when said second developer carrying member starts to rotate, said second developer carrying member is supplied with a voltage having a polarity which is opposite from a charge polarity of the developer, before said second developer carrying member is supplied with a voltage which is to be applied during the developing operation.

8. An apparatus according to claim 1, further comprising a plurality of image bearing members corresponding to said developing devices, respectively, and said developer carrying members are contactable to associated ones of the image bearing members, respectively, and when said second developer carrying member is not in operation for developing action, said second developer carrying member is at rest, and said second developer carrying member is spaced away from the associated one of the image bearing members, and wherein when said second developer carrying member is in operation for developing action, said second developer carrying member is contacted to the associated one of the image bearing members.

9. An apparatus according to claim 1, further comprising a plurality of image bearing members corresponding to said developing devices, respectively, and said developer carrying members are contactable to associated ones of the image bearing members, respectively, and when said second developer carrying member is not in operation for developing action, said second developer carrying member is at rest, and said second developer carrying member is spaced away from the associated one of the image bearing members, and wherein when said second developer carrying member is in operation for developing action, said second developer carrying member is supplied with a developing voltage, and then is contacted to the associated one of the image bearing members.

10. An apparatus according to claim 8 or 9, wherein said second developer carrying member is spaced away from the associated one of the image bearing members, the image bearing members is not rotated.

11. An apparatus according to claim 3, wherein the variable voltages applied to said developer carrying members are DC voltages.

12. An apparatus according to claim 1, further comprising a plurality of image bearing members corresponding to said developer carrying members, respectively.

13. An apparatus according to claim 1, wherein one of said developing devices is provided in a process cartridge detachably mountable to a main assembly of the image forming apparatus together with the image bearing member.

* * * * *

UNITED STATES PATENT AND TRADEMARK OFFICE

CERTIFICATE OF CORRECTION

PATENT NO. : 7,050,733 B2
APPLICATION NO. : 10/715533
DATED : May 23, 2006
INVENTOR(S) : Masanobu Saito et al.

It is certified that error appears in the above-identified patent and that said Letters Patent is hereby corrected as shown below:

ON THE TITLE PAGE

At Item (56), Foreign Patent Documents, "JP 04093693 A 3/1992" should read --JP 4-93693 A 3/1992--.

COLUMN 2

Line 37, "motions" should read --motion--.

COLUMN 3

Line 30, "contact" should read --the contact--;
Line 31, "peripheral" should read --the peripheral--;
Line 32, "direction" should read --a direction--, and "peripheral" should read --the peripheral--;
Line 40, "charger" should read --charge--; and
Line 52, "member with" should read --member, and a minimum of one means among the charging means for charging the photosensitive member, developing means for supplying the photosensitive member with--.

COLUMN 4

Line 33, "yellow, is" should read --yellow,--.

COLUMN 5

Line 31, "provided" should read --provide--.

COLUMN 10

Line 27, "direction or" should read --direction of--.

COLUMN 11

Line 27, "is development" should read --development--; and
Line 36, "source," should read --sources,--.

COLUMN 12

Line 17, "drawing)" should read --the drawing)--;
Line 28, "results" should read --result--; and
Line 35, "or the" should read --of the--.

COLUMN 13

Line 15, "well as" should read --as well as--.

UNITED STATES PATENT AND TRADEMARK OFFICE

CERTIFICATE OF CORRECTION

PATENT NO. : 7,050,733 B2
APPLICATION NO. : 10/715533
DATED : May 23, 2006
INVENTOR(S) : Masanobu Saito et al.

It is certified that error appears in the above-identified patent and that said Letters Patent is hereby corrected as shown below:

COLUMN 15

Line 33, "(length" should read --(the length--, "current" should read --the current--, and "development" should read --the development--.

Line 34, "development" should read --the development--; and "devel-" should read --the devel- --.

COLUMN 17

Line 14, "transfer bell" should read --transfer belt--.

COLUMN 18

Line 26, "descried" should read --described--; and

Line 36, "an cyan" should read --and cyan--.

COLUMN 19

Line 43, "having stuck" should read --have become stuck--.

COLUMN 20

Line 3, "and," should be deleted; and

Line 58, "ate fixed." should read --are fixed.--.

COLUMN 21

Line 18, "with" should be deleted.

Signed and Sealed this

Nineteenth Day of December, 2006

JON W. DUDAS
*Director of the United States Patent and Trademark Office*